United States Patent [19]

Dowden

[11] 4,424,994

[45] Jan. 10, 1984

[54] SECURITY SEALS

[75] Inventor: Anthony S. Dowden, London, England

[73] Assignee: American Casting and Manufacturing Corporation, Plainview, N.Y.

[21] Appl. No.: 285,871

[22] Filed: Jul. 22, 1981

[30] Foreign Application Priority Data

Jul. 24, 1980 [GB] United Kingdom ..... 8024224

[51] Int. Cl.[3] ..... B65D 33/34

[52] U.S. Cl. ..... 292/318

[58] Field of Search ..... 292/307 R, 318, 316, 292/320, 321

[56] References Cited

U.S. PATENT DOCUMENTS

| | | | |
|---|---|---|---|
| 3,127,648 | 4/1964 | Emery | 292/307 R X |
| 4,183,567 | 1/1980 | Bone | 292/318 |
| 4,263,697 | 4/1981 | Speedie | 24/206 A X |
| 4,299,417 | 11/1981 | McClure | 292/320 |
| 4,306,745 | 12/1981 | Wenk | 292/318 |

*Primary Examiner*—Richard E. Moore

*Attorney, Agent, or Firm*—Scully, Scott, Murphy & Presser

[57] ABSTRACT

A security seal comprises a main body element formed with a passage therein comprising a first portion leading from an entry opening, a second portion leading at an angle from said first portion, and a third portion leading at an angle from said second portion to an outlet opening. One end of an elongate flexible element is fixed to the main body element and the free end of the element is dimensioned to pass into and along said passage. The flexible element is formed along at least a part of its length with apertures adapted to engage with cooperating inclined resiliently flexible projections provided within the second portion of the said passage, the engagement between the projections and apertures being such as to prevent withdrawal of the flexible element from the passage.

20 Claims, 3 Drawing Figures

SECURITY SEALS

BACKGROUND OF THE INVENTION

The invention relates to security seals of the kind which are applied to closed containers in such manner that the container may only be opened by breaking the seal, the condition of the seal thereby giving an indication of whether or not the container has been opened.

A common type of seal for this purpose comprises a main body element to which is secured one end of an elongate flexible element the opposite end of which may be inserted in a passage or aperture in the main body element. The passage or aperture and the flexible element are formed with cooperating formations which are designed to give non-return engagement of the end of the flexible element within the passage or aperture so that the seal may only be released by breaking or cutting the flexible element. In use of the seal the flexible element will normally be passed through registering apertures in two parts of a closure device or around the neck of a bag to be sealed, such as a money bag.

Known seals of this type are effective provided they are properly applied to the container and provided they have not been tampered with before being applied.

However, known seals of this type are susceptible to pre-tampering in such manner that although the seal may appear to be correctly closed it is in fact in such a condition that it may readily be released and then reconnected. For example, it may be possible, by inserting a tool into the aperture or passage in the body element, to deform, reshape or remove some or all of the formations before the flexible element is inserted, so that the flexible element may subsequently be withdrawn from the passage. Thus the seal may give the appearance of being correctly applied, but a person who carried out or is aware of the pre-tampering can subsequently open the seal to gain access to the contents of the container and then reclose the seal, applying adhesive to the interengaging parts of the flexible element and body element so that ultimate opening of the seal may again only be achieved by breaking it, giving the appearance that the seal has not been opened.

Alternatively, a thin blade or shim may be inserted into the passage in the body element, prior to insertion of the flexible element. The blade or shim then prevents interengagement between the formation on the flexible element and in the passage and thus permits subsequent withdrawal of the flexible element from the passage.

The present invention sets out to provide a form of security seal which is less susceptible to pre-tampering of this kind.

SUMMARY OF THE INVENTION

According to the invention there is provided a security seal comprising a main body element formed with a passage therein comprising a first portion leading from an entry opening and a second portion leading at an angle from said first portion, and an elongate flexible element one end of which is fixed to the main body element and the other end of which is dimensioned to pass into said passage, the flexible element being formed along at least a part of its length with formations adapted to engage with cooperating formations provided within at least the second portion of the said passage, the engagement between the formations being such as to prevent withdrawal of the flexible element from the passage.

Since the second portion of the passage, on which the formations are provided, is inclined at an angle to the first portion leading from the entry opening, it is difficult to deform or remove any of the formations by inserting a tool into the passage.

The passage in the body element may also comprise a third portion leading at an angle from said second portion to an outlet opening. In this case the flexible element may pass completely through the passage in the main body element and project from the outlet opening to give further indication that the seal is properly applied. However, the arrangement of the third portion of the passage at an angle to the second portion again makes it difficult to tamper with the formations on the second portion by inserting a tool into the outlet.

The formations within the passage may comprise resiliently flexible projections extending from at least one wall of the passage and spaced apart along the length thereof, the formations on the flexible element comprising a plurality of apertures spaced apart along the length of the element in a manner to receive said resiliently flexible projections when the flexible element is inserted into the passage. Preferably the flexible projections extend at an angle, away from the entry opening, with respect to the wall of the passage.

DETAILED DESCRIPTION OF THE PREFERRED EMBODIMENT

The seal is moulded from plastics material and comprises a main body 10 and a tape-like elongate flexible tail 11 one end of which is secured to the main body 10, for example by being integrally moulded therewith.

Figure 1:
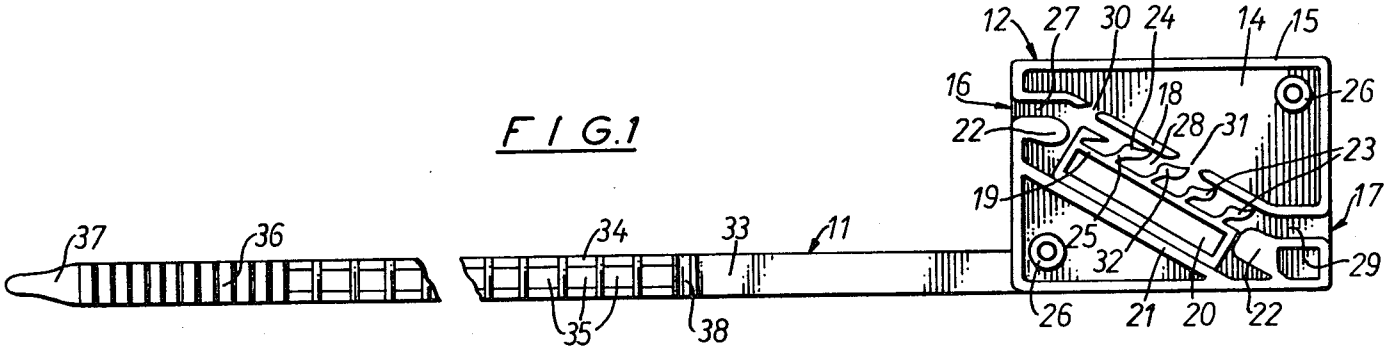
FIG. 1 is a plan view, on an enlarged scale, of a security seal according to the invention with the cover plate removed to show the internal construction.
Figure 2:
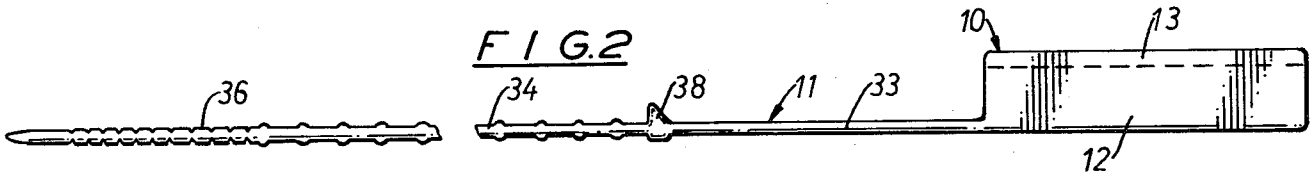
FIG. 2 is a side elevation of the seal.
Figure 3:
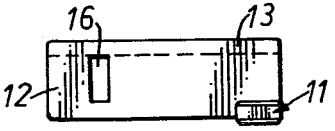
FIG. 3 is an end elevation of the seal.

The body 10 comprises a base part 12 and a cover plate 13, the cover plate being removed in FIG. 1 to show the internal construction of the base part. The base part 12 is formed from two components. The larger component is generally tray-like in configuration and comprises a flat bottom 14 surrounded by an upstanding peripheral wall 15. An inlet opening 16 and an outlet opening 17 are formed in the peripheral wall of the base part, and extending between the inlet opening 16 and outlet opening 17 are upstanding walls 18 and 19 which, together with part of the bottom wall 14, define an open-topped channel extending from the inlet opening 16 to the outlet opening 17. When the cover plate 13 is in position on the base part 12 the open-topped channel is covered to form an enclosed passage through the body element.

The wall 19 is provided on a separately formed component 20 of the base part 12 which is located with respect to the other tray-like component by means of an inclined wall 21 and abutments 22 formed thereon. A number of resiliently flexible projections 23 extend from the wall 19 on the component 20 towards the wall 18, and are inclined at an angle away from the opening 16 as they extend away from the wall 19 so as to act as barbs. Each projection 23 comprises an enlarged sloping head 24 connected to the wall 19 by a thinner neck 25.

Pillars 26 are integrally moulded with the base part 12 and cooperate with registering formations (not shown) on the cover plate 13 so as to locate the cover plate with respect to the base part. The cover plate and base part are then secured together, for example by electronic welding. As previously mentioned, when the cover plate 13 is secured in position on the base part it closes the open-topped channel on the base part 12 to form an enclosed passage, the passage comprising a first portion 27 leading from the entry opening 16, a second portion 28 leading at an angle from the first portion 27, and a third portion 29 parallel to the first portion 27 and leading to the outlet opening 17.

At the junction between the first portion 27 and second portion 28 of the passage there is provided in the wall 18 an opening 30 which is in line with the first passage portion 27 and thus forms an extension thereof. A further opening 31 is formed in the wall 18 midway along the second inclined portion 28 of the passage and is disposed opposite one of the projections 32 which is slightly larger than the other projection 23 and has a free end which extends slightly into the opening 31. The purpose of the openings 30 and 31 will be described below.

The flexible tail 11 comprises a smooth flat portion 33 adjacent the body 10, a central portion 34 formed with spaced rectangular apertures or gates 35, and a ridged end portion 36. The tail is also formed with a tapered tip 37. A stop member 38 is integrally moulded with the tail 11 at the junction between the portions 33 and 34.

When it is required to apply the seal to a container, the flexible tail 11 is passed through registering apertures in a closure device, or around the neck of a bag, and the tip 37 of the tail is inserted into the entry opening 16 of the passage in the main body 10. The tail 11 is pushed through the passage until the ridged portion 36 emerges from the outlet opening 17 whereupon the tail may be drawn tightly around the closure device or neck of the bag by pulling it tightly through the main body 10 until the stop member 38 engages the inlet opening 16.

It will be appreciated that the tail 11 may be connected to the body 10 at any convenient location other than that shown.

The number of apertures or gates 35 formed on the tail 11 is such that, when the seal has been applied, a number of the apertures within the inclined portion 28 of the passage in the body 10 will be engaged by the projecting elements 23, and this engagement will prevent withdrawal of the tail from the passage. Since the portion 28 of the passage is inclined with respect to the portions 27 and 29, access to the projections 23 cannot be obtained to remove or deform them prior to use of the seal so that the tail 11 might be removed from the body 10 after the seal has been applied. Furthermore, due to the provision of two angled bends in the passage, any tension applied to the tail from the direction of the entry opening 16 will tend to increase the pressure of the tail against the sides of the passage, and thus strengthen the engagement between the tail and the projections 23.

When it is required to break the seal, this can only be done by cutting or rupturing the portion 33 of the tail, and this break will be virtually impossible to repair in any manner which will not be apparent from close inspection of the seal.

The seal is also designed to reduce the risk of pre-tampering. As mentioned above, the angle arrangement of the passage prevents the insertion of a tool to deform or remove the projections 33. Another possible method of pre-tampering is to insert a thin shim or blade into the passage before the tail is inserted so that when the tail is inserted the shim lies between the tail and the projections 23 and prevents the projections entering the apertures 35 in the tail. It would then be possible subsequently to withdraw the tail from the passage without breaking the seal. The seal shown in the drawings makes such pre-tampering impossible.

In order also to permit the insertion of the tail into the passage any shim used for the above pre-tampering purpose must necessarily be considerably thinner than the tail and must be flexible so as to pass along the inclined passage. However, if such a thin shim were to be inserted into the entry opening 16 it would pass into the extension opening 30 and would not normally therefore be deflected to pass along the inclined portion 28 of the passage. The depth of the extension opening 30 is less than the thickness of the tail 11 so that when the tail is inserted it does not pass into the opening 30 but is deflected along the inclined portion 28 of the passage.

If, by some means, the person attempting to introduce a shim into the passage succeeds in getting it past the opening 30, then the projection 32 and opening 31 prevent the shim passing along the whole length of the inclined portion 28 of the passage. When the leading edge of the shim meets the larger projections 32 it is deflected by the inclined surface of the projection into the opening 31 and is thereby prevented from passing along the whole length of the passage. The shim will therefore be ineffective for preventing proper engagement of the tail 11 with the projections 23.

A shim will be deflected into the opening 31 by the projection 32 because the shim must necessarily be thin and flexible in order to pass along the passage while leaving sufficient space for the subsequent insertion of the tail 11. However the tail 11 itself, being thicker and stiffer than the shim, is sufficiently stiff to overcome the resilience of the projection 32 and, when passed along the passage, it will therefore deflect the projection 32 and will not be diverted into the opening 31.

The portion 33 of the tail 11 may have a weakened location, for example at the junction between the tail and the body 10, to facilitate rupture of the tail when it is required to break the seal. In this case the body 10 may be formed with protrusions which engage with similar protrusions on the tail adjacent the weakened location so that by pressing the protrusions together as the tail is drawn through the passage in the body 10 the weakened location is relieved of the tension applied to the tail and is not therefore subject to premature rupture.

I claim:

1. A security seal comprising a main body element formed with a passage therein, said passage having a first portion leading from an entry opening and a second portion leading at an angle from said first portion; an elongate flexible element, one end of which is fixed to the main body element and the other end of which is dimensioned to pass into said passage; said body element defining at the junction between said first portion and the second portion of the passage, an extension of said first portion which is so dimensioned as to prevent the entry of the flexible element into the extension, but to permit the entry into the extension of an element introduced into the first portion of the passage which is thinner than the flexible element; said flexible element being formed along at least part of its length with formations adapted to engage with cooperating formations provided within at least the second portion of said passage, and the engagement between the formations being such as to prevent withdrawal of the flexible element from the passage.

2. A security seal, said seal comprising:

(a) a main body element formed with a passage therein comprising a first portion leading from an entry opening and a second portion leading at an angle from said first portion;

(b) an elongate flexible element, one end of which is fixed to the main body element and the other end of which is dimensioned to pass into said passage, said flexible element being formed of long at least part of its length with a plurality of spaced apart apertures;

(c) a plurality of resiliently flexible projections extending from at least one wall of said passage and spaced apart to cooperate with said spaced apart apertures when the flexible element is inserted into said passageway;

(d) an aperture formed in a part of a wall of the second portion of the passage opposite one of the resilient flexible projections, the projection being shaped to devert into said aperture the leading end of a thin flexible member passing along the passage;

(e) an elongate flexible element being sufficiently stiff to overcomes the resilience of the projections and avoid being deverted as it passes along said passage, said cooperating apertures and projections thereafter preventing the withdrawal of the flexible element from the passage.

3. A flexible tamper proof security seal having a non-releasable one way engaging means, said seal comprising:

(a) a flexible elongated element having first and second ends and defining a long at least part of its length, a plurality of formations that form part of a non-releasable one way gripping means;

(b) a main body element, said main body element permanently securing said elongated element at its first end, said main body element further defining;

(i) offset entry and exit opening spaced apart from one another, said entry openings adapted to receive the second end of said flexible elongated tie;

(ii) an angled passageway through said main body, said angled passageway being angled with respect to both said entry and exit openings;

(iii) a plurality of one way formations mounted within said main body element along said angled passageway for engaging and securing the cooperating one way formations defined by said elongated flexible element;

whereby said offset entry and exit openings prevent access by unauthorized persons through either the entry opening or the exit opening to the engagement of the cooperating one way formations after said elongated element has passed through said entry opening and engaged said plurality of one way formations mounted within said main body element.

4. A security seal as claimed in claim 2 wherein said one projection has an inclined surface which extends at least partly across the passage, leading to a free end of the projection which extends partly into an aperture.

5. A security seal as claimed in claim 3 wherein the portion of the elongate flexible element which may pass into the passage into the body element is longer than said passage, whereby said second end of the flexible element may project beyond the outlet opening.

6. A security seal as claimed in claim 5 wherein a portion of the flexible element adjacent said second end is ridged.

7. A security seal as claimed in claim 3 wherein the cross sectional dimensions of the flexible elongated element are selected to substantially fill the offset entry and exit openings to thereby prevent the insertion of any additional flexible elements after said flexible elongated element has passed through said entry and exit openings.

8. A security seal according to claims 1 or 2, wherein the main body element is formed with an outlet opening and the passage in the body element comprises a third portion leading at an angle from said second portion to said outlet opening.

9. A security seal according to claim 8, wherein the portion of the elongated flexible element which may pass into the passage in the body element is longer than said passage, whereby said other end of the flexible element may project beyond said outlet opening.

10. A security seal according to claim 9, wherein a portion of the flexible element adjacent said other end thereof is ridged.

11. A security seal according to claims 1 or 2 or 3, wherein the elongate flexible element is formed with a stop member which is larger than said entry opening to limit the extent to which the flexible element may be passed through said opening.

12. A security seal according to claim 1, wherein the formations within the passage comprise resiliently flexible projections extending at least one wall of the passage and spaced apart along the length thereof, and wherein the formations on the flexible element comprise a plurality of apertures spaced apart along the length of the element in a manner to receive said resiliently flexible projections when the flexible element is inserted into the passage.

13. A security seal according to claim 12, wherein the resiliently flexible projections within the passage extend at an angle, away from the entry opening, with respect to the wall of the passage.

14. A security seal according to claims 1 or 3, wherein an aperture is formed in a part of a wall of the second portion of the passage which is opposite one of said resiliently flexible projections, which projection is shaped to divert into said aperture the leading end of a thin flexible member passing along the passage, the aforesaid flexible element being sufficiently stiff to overcome the resilience of the projection and avoid being so diverted as it passes along the passage.

15. A security seal according to claim 14, wherein said one projection has an inclined surface which extends at least partly across the passage, leading to a free end of the projection which extends partly into said aperture.

16. A security seal according to claims 1 or 2 or 3, wherein the resiliently flexible projections all extend away from one wall of the passage and have free ends thereof adjacent the opposite wall of the passage.

17. A security seal according to claims 1 or 2 or 3, wherein each resiliently flexible projection comprises a head portion connected to the wall of the passage by a thinner neck portion.

18. A security seal according to claims 1 or 2 or 3, wherein the main body element comprises a base part and a cover part, the base part being formed with an open-topped channel from one side wall of which said resiliently flexible projections extend, and the cover part being secured to the base part to close the channel and thereby form said passage.

19. A security seal according to claim 18, wherein the base part of the main body element comprises a first component providing the bottom wall and at least one side wall of the channel, and a second, separately formed component providing at least part of the other side wall of the channel and the resiliently flexible projections extending therefrom, means being provided to locate the first and second components relative to one another to form said base part.

20. A security seal according to claims 2 or 3, wherein there is formed in the main body element, at the junction between the first and second portions of said passage, an extension of said first portion which is so dimensioned as to prevent the entry of the flexible element into the extension, but to permit the entry into the extension of an element introduced into the first portion of the passage which is thinner than the flexible element.

* * * * *